United States Patent [19]

Yoshimoto

[11] 4,212,479

[45] Jul. 15, 1980

[54] ROLLER SKATE

[76] Inventor: Koichi Yoshimoto, 3-15-310, Takaodori, 4-chome, Nata-ku, Kobe-shi, Hyogo-ken, Japan

[21] Appl. No.: 943,221

[22] Filed: Sep. 18, 1978

[51] Int. Cl.[2] ..... A63C 17/02

[52] U.S. Cl. ..... 280/11.28; 280/11.19

[58] Field of Search ..... 280/11.28, 11.27, 11.1 R, 280/11.19; 16/18 A

[56] References Cited

U.S. PATENT DOCUMENTS

| | | | |
|---|---|---|---|
| 346,664 | 8/1886 | Libbey | 280/11.27 |
| 1,936,701 | 11/1933 | Wilson | 16/18 A X |
| 2,510,722 | 6/1950 | Snyder | 280/11.28 |
| 2,557,331 | 6/1951 | Wintercorn | 280/11.28 |
| 3,414,280 | 12/1968 | Ohashi | 280/11.19 |
| 3,993,318 | 11/1976 | Rothmayer | 280/11.26 |

FOREIGN PATENT DOCUMENTS

| | | | |
|---|---|---|---|
| 654100 | 12/1937 | Fed. Rep. of Germany | 280/11.28 |

*Primary Examiner*—John J. Love
*Assistant Examiner*—Milton L. Smith
*Attorney, Agent, or Firm*—Sherman & Shalloway

[57] ABSTRACT

A roller skate has a front lever and a rear lever mounted on a base plate, as well as pairs of hemispherical rollers, each pair of rollers being supported by axles which are held by each of the levers and which are tilted toward the skating surface. Each lever is supported by a base plate by means of a horizontal shaft directed at right angles to the running direction of the roller skate in such a manner that the lever is allowed to turn about the axis of the shaft thereby to absorb shocks transmitted from the rollers.

1 Claim, 4 Drawing Figures

ROLLER SKATE

BACKGROUND OF THE INVENTION

1. Field of the Invention

This invention relates to a roller skate and more specifically, to a roller skate having hemispherical rollers.

2. Description of the Prior Art

A roller skate having two hemispherical roller pairs has been disclosed in U.S. Pat. No. 3,993,318 issued to Rothmayer. The combination of two hemispherical rollers constitutes a nearly spherical surface and permits the skate to be inclined thereby giving a feeling like that of an ice skate. When this skate is to be used on uneven or rough skating surfaces, however, it is desired to provide a shock-absorbing mechanism in order that vibrations and shocks transmitted to the feet of the wearer can be absorbed. A shock-absorbing mechanism designed for roller skates has been disclosed in U.S. Pat. No. 2,557,331 issued to Wintercorn. The spring suspension mechanism disclosed in this patent exhibits effective shock-absorbing function but results in complicated and bulky mechanism so that it can withstand heavy loads that will be exerted during skating. Therefore, increased demand has been placed on producing further improved mechanisms.

SUMMARY OF THE INVENTION

The principal object of this invention is to provide a roller skate equipped with a roller-support mechanism which effectively exhibits the shock-absorbing effect and further withstands heavy loads.

In order to attain the abovementioned object, the roller skate of this invention is equipped with a pair of front and rear roller-mounting members or levers that are so mounted on a base plate or chassis as to rotate about horizontal axes, said horizontal axes being directed nearly at right angles to the running direction of the roller skate. Each of the levers has a portion which extends substantially in parallel with the lower surface of the chassis, and a portion which extends downwardly at a given angle. The former portion is connected to the chassis via a resilient member, and the latter portion supports at its tip a pair of rollers. That is, each of the levers rotates responsive to the change in load exerted on the rollers thereby creating suitable resiliency to absorb shocks.

Further, according to the roller skate of this invention, the rollers of each pair are respectively supported by downwardly directed axles located at one end of the lever. Such a setup provides upwardly broadened and downwardly narrowed space between the pair of opposing rollers, permits the lever having sufficient thickness and strength to be positioned between the pair of rollers, and permits the pair of rollers to come into contact with the skating surface while maintaining a small gap between the rollers so that smooth rolling can be materialized.

The abovementioned two factors are important requirements for providing a simply constructed roller skate which gives comfortable skating feeling.

Other objects and features of the invention will become obvious from the perusal of the following description in conjunction with the accompanying drawings.

DETAILED DESCRIPTION OF PREFERRED EMBODIMENTS

Figure 1:
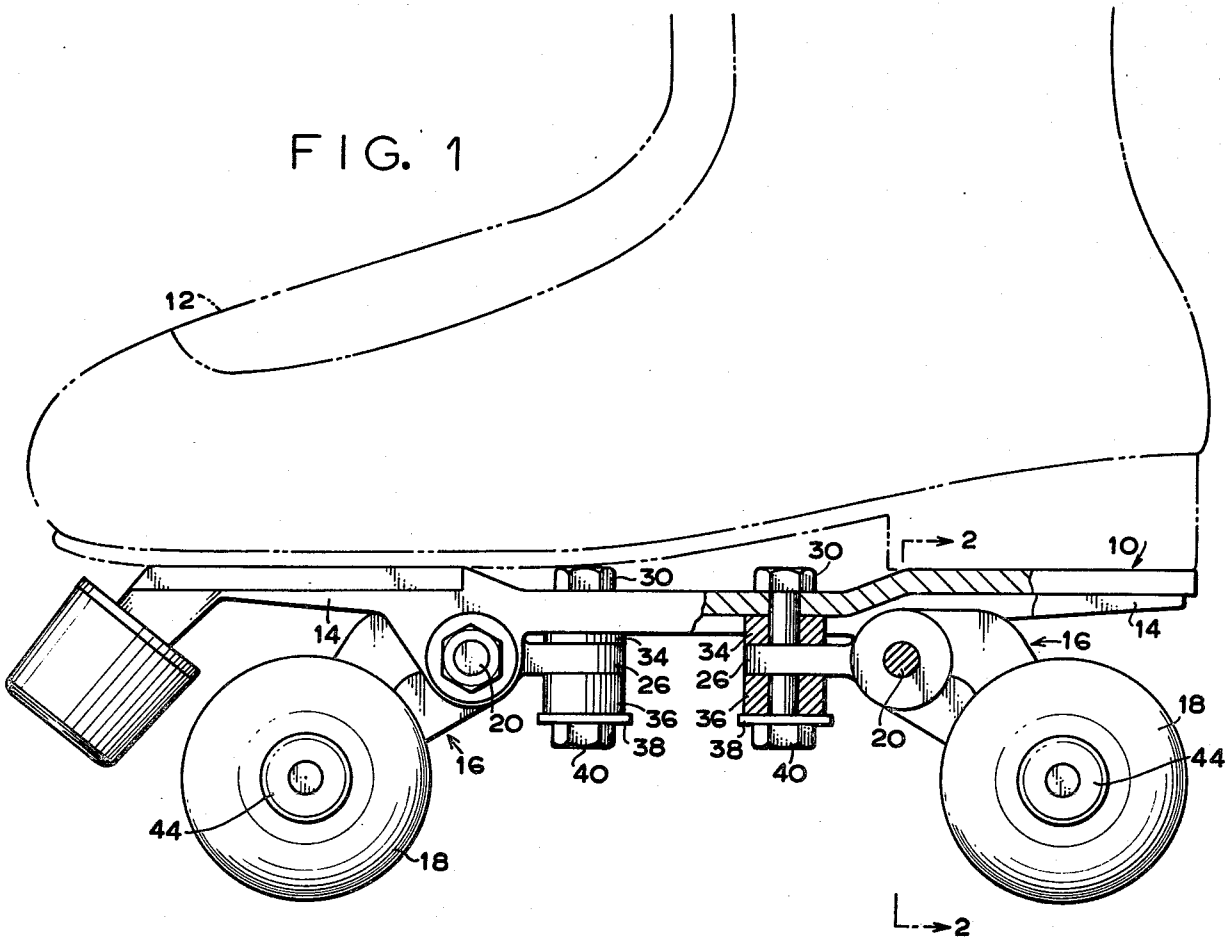
FIG. 1 is a partly cut-away side view showing a roller skate according to this invention.
Figure 2:
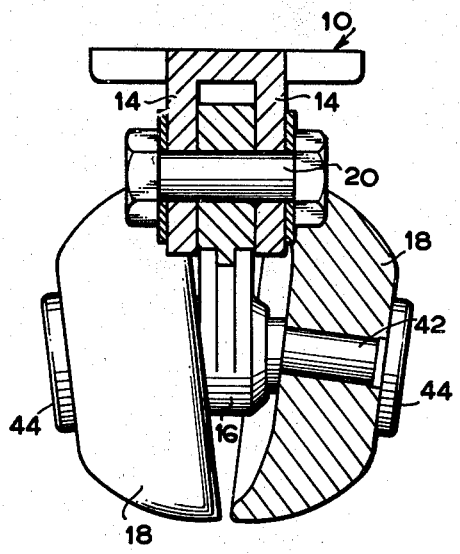
FIG. 2 is a cross-sectional view taken along the line 2—2 of FIG. 1.

Referring now to the accompanying drawings, a base plate or chassis designated at 10 in FIGS. 1 and 2 is of the shape of a narrow plate to be fastened to the lower surface of a shoe 12 positioned thereon by way of a fastening means such as bolts. The chassis 10 has on its lower surface a pair of ridges 14 which extend in the lengthwise direction and provide portions for supporting roller-mounting members or levers 16 each of which rotatably supports a pair of rollers 18 by means of shafts 20. The ridges 14 further work to reinforce the chassis 10.

Figure 4:
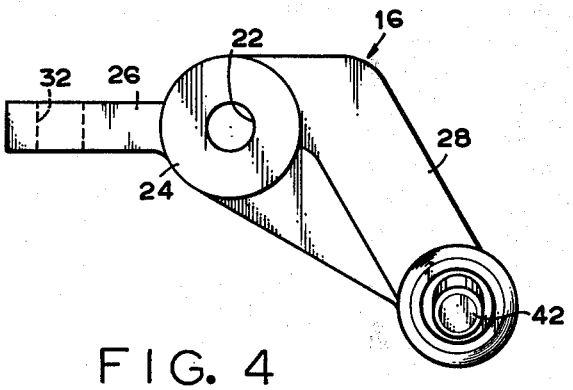
FIG. 4 is a side view showing the roller-mounting member of FIG. 3.
Figure 3:
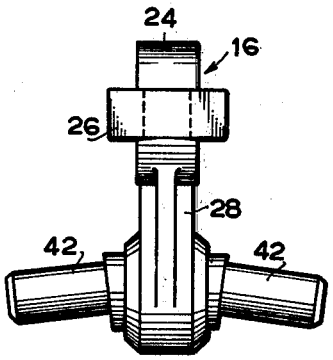
FIG. 3 is a front view of a roller-mounting member used for the roller skate of FIG. 1.

As clearly shown in FIGS. 3 and 4, the lever 16 has a pivot portion 24 with a bore 22 through which is inserted the shaft 20, a first portion 26 extending in a hhorizontal direction from the pivot portion 24, and a second portion 28 extending downwardly and aslantly from the pivot portion 24 in a direction opposite to that of the first portion 26. The first portion 26 possesses a bore 32 through which penetrates a connection rod 30 which penetrates through the chassis 10. The rod 30 penetrates through a cushion ring 34 placed between the chassis 10 and the first portion 26, through a cushion ring 36 placed beneath the first portion 26, and through a washer 38, and has a nut 40 which is screwed at the tip portion as shown in FIG. 1. Therefore, when rotated about the shaft 20, the lever 16 compresses the cushion ring 34 or 36. The cushion rings 34 and 36, preferably, are made of a resilient material such as polyurethane or silicone rubber, and permit the lever 16 to turn limitedly so that the shock exerted on the lever 16 is effectively absorbed. The shock-absorbing mechanism can be obtained when compression springs are used as resilient members 34 and 36.

Referring again to FIGS. 3 and 4, a pair of axles 42 which are extending aslantly and downwardly toward the outer side are integrally provided at the tip of the second portion 28 of the lever 16, whereby the rollers 18 are rotatably supported by each of the axles. The downwardly directed angle of the axles 42 will be suitably selected, for example, in a range of from 5° to 15°. According to this embodiment, the angle is set at about 7°.

As clearly shown in FIG. 2, each roller 18 is of the form of a hemisphere, the apex portion of which being cut flat, and is supported on an axle 42, the bottom surface facing the other roller. An end cap 44 is provided to prevent each roller from being slipped off from the axle 42. Since the two axles 42 of the lever 16 are downwardly inclined, the pair of rollers 18 supported by the axles 42 are so located as to be close each other at their lower portions and apart from each other at their upper portions. In other words, the width of space defined between the pair of rollers 18 is the narrowest at the lower end and gradually broadens toward the upper direction, enabling the second portion 28 of the lever 16 to be accomodated in space defined by the pair of rollers.

Moreover, the pair of oppositely inclined rollers 18 establish a nearly arcuate contacting portion at their lowest point. A narrow gap is defined between them. The contacting point permits the roller skate to roll without substantial motion in the upper and lower directions.

Another advantage resulting from the downwardly inclined axles 42 is that part of the load exerted on the rollers 18 is oriented in the thrust direction of the axles 42. Therefore, the load exerted on the connecting portions between the axles 42 and the lever 16 is reduced.

Although the foregoing description has been made to the lever 16 and rollers 18 on the rear side, the lever 16 and rollers 18 on the front side are also constructed substantially in the same manner (but the lever 16 is attached in the opposite direction). Therefore, the description related to the lever and rollers on the rear side can be applied to the lever and rollers on the front side.

As mentioned above, since the roller skate of this invention has arcuate contacting portions formed by two pairs of rollers 18, it is allowed to roll without being accompanied by a change in height from the ground level, thereby giving the wearer comfortable skating feeling similar to that of an ice skate. Even when rolling on uneven skating surfaces, shocks in the upper and lower directions given to the rollers 18 are effectively absorbed by the turn of the shock-absorbing lever 16.

What is claimed is:

1. A roller skate comprising:

a base plate to be mounted on the bottom of a shoe;

front and rear roller-mounting members that are rotatably mounted on the lower surface of said base plate via shafts which are nearly at right angles to the running direction of the roller skate and which are nearly in parallel with a skating surface, said roller-mounting members having a first portion disposed in parallel with the lower surface of said base plate, and a second portion extending aslantly from one end of said first portion toward the surface of the skating surface;

a shock-absorbing mechanism having a connection rod which penetrates through said base plate and said first portion to connect said first portion of said roller-mounting portion to said base plate, and elastic members which are placed between said base plate and said first portion, and between said first portion and a tip of said connection rod;

a pair of axles attached to a second portion of said roller-mounting member and extending in the opposite directions and toward the skating surface;

hemispherical rollers supported by each of said axles; and said base plate having a pair of ridges on the lower surface thereof, and a pair of shafts supported between said ridges, each of said shafts supporting said roller-mounting members.

* * * * *